US012291801B2

(12) United States Patent
Pai

(10) Patent No.: US 12,291,801 B2
(45) Date of Patent: May 6, 2025

(54) AIR TEXTURED YARN (ATY) AND MANUFACTURING METHOD THEREOF

(71) Applicant: SUNTEX FIBER CO., LTD., Homei Changhwa (TW)

(72) Inventor: Hung Yu Pai, Homei Changhwa (TW)

(73) Assignee: SUNTEX FIBER CO., LTD., Homei Changhwa (TW)

( * ) Notice: Subject to any disclaimer, the term of this patent is extended or adjusted under 35 U.S.C. 154(b) by 26 days.

(21) Appl. No.: 17/363,680

(22) Filed: Jun. 30, 2021

(65) Prior Publication Data

US 2021/0324547 A1 Oct. 21, 2021

Related U.S. Application Data

(60) Provisional application No. 63/068,621, filed on Aug. 21, 2020.

(51) Int. Cl.
*D02G 3/34* (2006.01)
*D01D 5/253* (2006.01)

(52) U.S. Cl.
CPC ..... *D02G 3/34* (2013.01); *D01D 5/253* (2013.01)

(58) Field of Classification Search
CPC ..... D01D 5/253; D02G 3/34
USPC ..... 428/221
See application file for complete search history.

(56) References Cited

U.S. PATENT DOCUMENTS 4,341,063 A * 7/1982 Southerlin ..... D02G 1/16 28/258
5,462,790 A * 10/1995 Matsuki ..... D03D 15/573 442/309
2002/0045395 A1 4/2002 Lintecum et al.
2012/0114940 A1 5/2012 Kamada et al.
2016/0032501 A1* 2/2016 Baychar ..... D03D 15/292 442/194

FOREIGN PATENT DOCUMENTS

| | | | |
|---|---|---|---|
| CN | 1664200 | A | 9/2005 |
| CN | 1993508 | A | 7/2007 |
| CN | 101560715 | A | 10/2009 |
| CN | 102251324 | B | 1/2013 |
| CN | 104711743 | A | 6/2015 |
| JP | S-61124637 | A | 6/1986 |

(Continued)

OTHER PUBLICATIONS

Office Action mailed Oct. 26, 2022 in KR Application No. 10-2021-0109720, 34 pages, w/English-language translation.

(Continued)

*Primary Examiner* — Lynda Salvatore

(74) *Attorney, Agent, or Firm* — MUNCY, GEISSLER, OLDS & LOWE, P.C.

(57) ABSTRACT

An air textured yarn (ATY) is disclosed. The ATY includes a first filament having a first cross section, and a second filament disposed adjacent to the first filament having a second cross section, wherein the first cross section has a substantially circular shape and has a degree of modification (M ratio) less than or substantially equal to 1.3, the second cross section has a polygonal shape including 3 to 6 lobes, and a difference between a length of the first filament and a length of the second filament is less than or substantially equal to 4%. Further, a method of manufacturing the ATY is also disclosed.

6 Claims, 13 Drawing Sheets

(56) References Cited

FOREIGN PATENT DOCUMENTS

| | | | |
|---|---|---|---|
| JP | S63-126939 | A | 5/1988 |
| JP | S63-249728 | A | 10/1988 |
| JP | A-1988126939 | | 5/1989 |
| JP | A-1988249728 | | 10/1989 |
| JP | H03260128 | | 11/1991 |
| JP | H-4316624 | A | 11/1992 |
| JP | H-04316624 | A | 11/1992 |
| JP | 2005-519204 | | 6/2005 |
| JP | 2010196178 | A | 9/2010 |
| JP | 2020015992 | A | 1/2020 |
| KR | 10-2004-0102023 | | 12/2004 |
| KR | 20040102023 | A | 12/2004 |
| KR | 10-2015-0069595 | | 6/2015 |
| KR | 20150069595 | A | 6/2015 |
| TW | 200821419 | A | 5/2008 |
| WO | WO-03074769 | A1 | 9/2003 |
| WO | 2016117177 | A1 | 7/2016 |
| WO | WO-2019064056 | A1 | 4/2019 |

OTHER PUBLICATIONS

An Notice of Final Rejection in corresponding KR Application No. 10-2021-0109720 dated May 12, 2023 is attached 4 pages.

An Office Action in corresponding Vietnamese Application No. 1-2021-05154 dated Dec. 15, 2023 and its English translation, 2 pages each.

A Final Rejection in corresponding KR Application No. 10-2021-0109720 dated Sep. 13, 2023 and its English Translation are attached, 4 pages each.

Notice of Allowance dated Aug. 29, 2023 from Japan Patent Office (JPO) for Japanese counterpart application No. 2021-127808, 2 pages.

* cited by examiner

AIR TEXTURED YARN (ATY) AND MANUFACTURING METHOD THEREOF

This application claims priority of U.S. provisional application Ser. No. 63/068,621 filed on 21 Aug. 2020, which is incorporated by reference in its entirety.

TECHNICAL FIELD

The present disclosure relates to an air textured yarn (ATY) multi-lobed fiber, and particularly relates to an ATY having small, dense and uniform loops. Further, the present disclosure relates to a fabric made of such ATY. Further, the present disclosure relates to a method of manufacturing such ATY.

DISCUSSION OF THE BACKGROUND

Air textured yarn (ATY) includes polymeric filaments interlacing with each other to form crimps and loops that interlock with each other and lock the polymeric filaments together. Such interlacing and interlocking are caused by an air texturizing process. The air texturizing process is a mechanical method of producing the ATY with crimps and loops by blowing an air or liquid toward the polymeric filaments.

Dimensions of crimps and loops in the polymeric filaments would essentially affect quality of the ATY as well as a feeling offered by a fabric made of such ATY. Conventional ATY is formed by two filaments with large length difference, and thus has large loops and long crimps, which causes the conventional ATY snag easily. Furthermore, the conventional ATY has loops of lesser density and thus has less of a fluffy feeling. In addition, a fabric made of such conventional ATY would have an undesirable see-through effect.

Accordingly, there is a continuous need to improve a configuration and manufacturing method of the ATY.

This Discussion of the Background section is provided for background information only. The statements in this Discussion of the Background are not an admission that the subject matter disclosed in this section constitutes prior art to the present disclosure, and no part of this Discussion of the Background section may be used as an admission that any part of this application, including this Discussion of the Background section, constitutes prior art to the present disclosure.

SUMMARY

One aspect of the present disclosure provides an air textured yarn (ATY). The ATY includes a first filament having a first cross section; and a second filament disposed adjacent to the first filament and having a second cross section. The first cross section has a substantially circular shape and has a degree of modification (M ratio) less than or substantially equal to 1.3, the second cross section different from the first cross section has a polygonal shape including 3 to 6 lobes, and a difference between a length of the first filament and a length of the second filament is less than or substantially equal to 4%.

In some embodiments, the length of the first filament is substantially equal to the length of the second filament.

In some embodiments, the second cross section has an M ratio greater than 1.5.

In some embodiments, the M ratio of the second cross section is in a range of about 1.6 to about 3.

In some embodiments, the second cross section has the polygonal shape including 5 or 6 lobes.

In some embodiments, the ATY further includes a third filament disposed adjacent to the first filament and the second filament and having a third cross section, wherein the third cross section is different from the first cross section of the first filament and the second cross section of the second filament.

In some embodiments, the ATY further includes a loop formed by the first filament or the second filament, wherein a height of the loop is less than 480 μm.

One aspect of the present disclosure provides a fabric comprising an ATY. The ATY includes a first filament having a first cross section; and a second filament disposed adjacent to the first filament and having a second cross section, wherein the first cross section has a substantially circular shape and has an M ratio less than 1.3, the second cross section different from the first cross section has a polygonal shape including 3 to 6 lobes, and a difference between a length of the first filament and a length of the second filament is less than or substantially equal to 4%.

One aspect of the present disclosure provides a method of manufacturing an ATY. The method includes extruding a first filament and a second filament from a yarn magazine; feeding the first filament into a nozzle unit by a first feeding member of a feeding unit at a first feeding speed; feeding the second filament into the nozzle unit by a second feeding member of the feeding unit at a second feeding speed; blowing the first filament and the second filament by a flow in the nozzle unit to form the ATY including the first filament and the second filament; pulling the ATY out from the nozzle unit by a delivery unit; and taking up the ATY from the delivery unit by a take up unit, wherein a difference between the first feeding speed and the second feeding speed is less than or equal to 4%, a first cross section of the first filament and a second cross section of the second filament have different cross-sectional shapes, the first cross section of the first filament has a substantially circular shape and has a degree of modification (M ratio) less than or substantially equal to 1.3, and the second cross section of the second filament has a polygonal shape including 5 or 6 lobes and has an M ratio substantially greater than 1.5.

In some embodiments, the first feeding speed is substantially equal to the second feeding speed.

The method further includes feeding a polymeric material into a spinneret; forming a first filament and a second filament from the polymeric material; outputting the first filament and the second filament from the spinneret; combining the first filament and the second filament to form a yarn; and conveying the yarn including the first filament and the second filament to the yarn magazine.

The method further includes feeding a polymeric material into a first spinneret and a second spinneret; forming a first filament and a second filament from the polymeric material; outputting the first filament from the first spinneret and the second filament from the second spinneret; combining the first filament and the second filament to form a yarn; and conveying the yarn including the first filament and the second filament to the yarn magazine.

The present disclosure provides an ATY having small, dense and uniform loops. The ATY comprises a first filament having a substantially circular cross section and an M ratio less than or substantially equal to 1.3, and a second filament having a second cross section different from the first cross section. The second cross section has a polygonal cross section including 3 to 6 lobes. The first filament and the second filament are fed into a nozzle unit at a same or approximately same feeding speed, and then texturized by the nozzle unit. The first and second filaments are blown by a compressed air, gas or liquid fluid supplied from the nozzle unit in order to form loops protruding from the ATY.

As a result, a yarn including the first filament and the second filament is texturized by air, gas or liquid fluid to become the ATY. Since the first and second filaments have different cross-sectional profiles with different aerodynamic effects and are fed into the nozzle unit at a same or approximately same speed, loops having desired dimension, density and distribution can be produced.

The ATY with small, dense and uniform loops can offer a fluffy, comfortable or cotton-like feeling. Furthermore, since the loops protruding from the ATY are small in size, snagging can be reduced. In addition, a fabric, garment or clothing made of such ATY has a low see-through effect.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes as those of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the disclosure accompanies drawings, which are incorporated in and constitute a multi-lobed fiber, a spinneret assembly and a method for manufacturing a multi-lobed fiber of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "some embodiments," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

As used herein, the terms "approximately," "substantially," "substantial" and "about" are used to describe and account for small variations. For example, when used in conjunction with a numerical value, the terms can refer to a range of variation less than or equal to ±4% of said numerical value, such as less than or equal to ±4%, less than or equal to ±3%, less than or equal to ±2%, less than or equal to ±1%, less than or equal to ±0.5%, less than or equal to ±0.1%, or less than or equal to ±0.05%. For example, two numerical values can be deemed to be "approximately," "substantially" or "about" the same if a difference between the values is less than or equal to ±4% of an average of the values, such as less than or equal to ±4%, less than or equal to ±3%, less than or equal to ±2%, less than or equal to ±1%, less than or equal to ±0.5%, less than or equal to ±0.1%, or less than or equal to ±0.05%.

In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1:
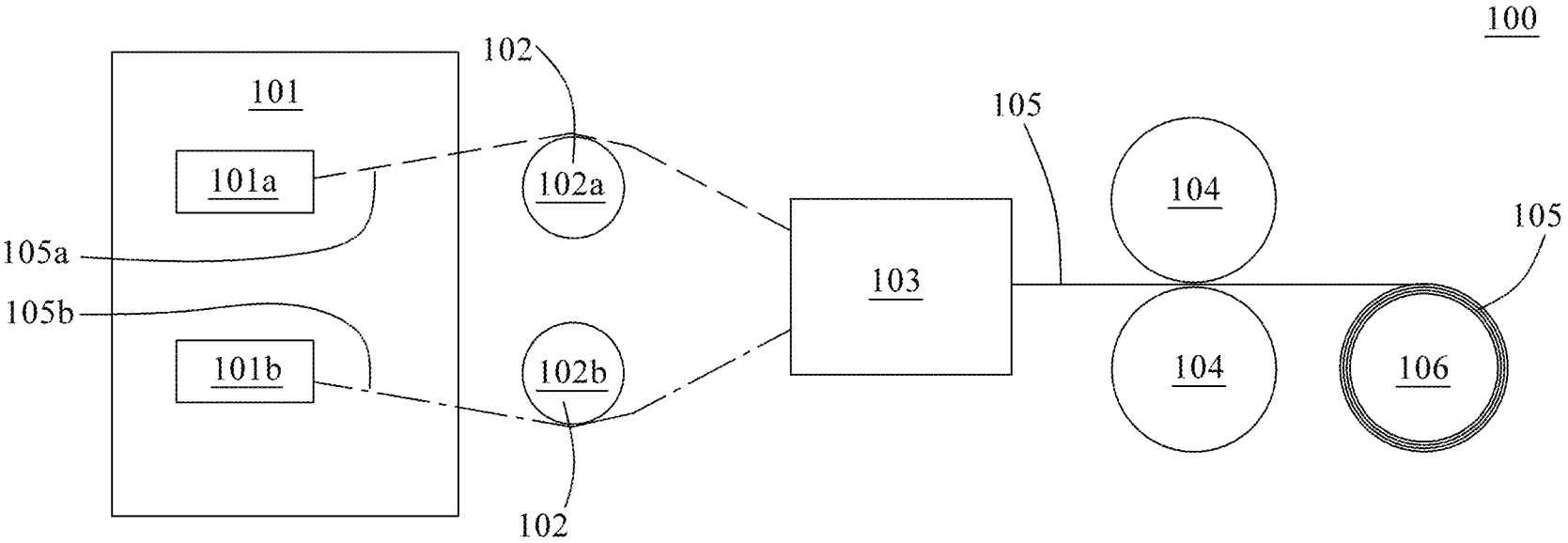
FIG. 1 is a schematic side view of an air texturing machine according to one embodiment of the present disclosure.

FIG. 1 is a schematic side view of an air texturing machine 100 according to one embodiment of the present disclosure. In some embodiments, the air texturing machine 100 is configured to manufacture an air texturized yarn (ATY) 105. In some embodiments, the air texturing machine 100 is configured to implement an air texturing process or a method of manufacturing the ATY 105. In some embodiments, the air texturing machine 100 includes a yarn magazine 101, a feeding unit 102, a nozzle unit 103, a delivery unit 104 and a take up unit 106.

In some embodiments, the yarn magazine 101 is configured to draw out filaments. In some embodiments, the filaments are formed from a polymeric material such as polyester, nylon, polypropylene or the like. In some embodiments, the yarn magazine 101 includes a first extruding member 101*a* and a second extruding member 101*b*. In some embodiments, a first filament 105*a* is extruded from the first extruding member 101*a*, and a second filament 105*b* is extruded from the second extruding member 101*b*.

In some embodiments, the first filament 105*a* and the second filament 105*b* can have same or different configurations. In some embodiments, the first filament 105*a* and the second filament 105*b* have different cross-sectional shapes. In some embodiments, the first filament 105*a* has a substantially circular cross section. In some embodiments, the second filament 105*b* has a polygonal cross section including 3 to 6 lobes.

Although only two filaments 105*a* and 105*b* are involved in this embodiment as shown in FIG. 1, it can be understood that a number of the filaments is adjustable as desired. In other words, more than one filament can be extruded from the yarn magazine 101, and more than one filament can be drawn out from the yarn magazine 101 and fed into the nozzle unit 103, such that the ATY 105 including more than one filament can ultimately be formed.

Further, it can be understood that the ATY 105 can include more than one filament, and at least one of the filaments has a cross section different from those of other filaments. In some embodiments, the ATY 105 includes three filaments having cross sections different from each other. For example, three filaments can include a filament having a substantially circular cross section, a filament having a polygonal cross section including 3 or 4 lobes, and a filament having a polygonal cross section including 5 or 6 lobes.

In some embodiments, the feeding unit 102 is disposed adjacent to the yarn magazine 101. In some embodiments, the first filament 105*a* and the second filament 105*b* are conveyed to the feeding unit 102. In some embodiments, the feeding unit 102 includes a first feeding member 102*a* for feeding the first filament 105*a* into the nozzle unit 103, and a second feeding member 102*b* for feeding the second filament 105*b* into the nozzle unit 103. In some embodiments, the first feeding member 102*a* and the second feeding member 102*b* are feeding rollers.

In some embodiments, the first filament 105*a* is fed into the nozzle unit 103 at a first feeding speed, and the second filament 105*b* is fed into the nozzle unit 103 at a second feeding speed. In some embodiments, a difference between the first feeding speed and the second feeding speed is less than or substantially equal to 4%. In some embodiments, the first feeding speed and the second feeding speed are the same or approximately the same. In other words, the first feeding speed is substantially equal to the second feeding speed. The substantially equal first feeding speed and second feeding speed thus results in the substantially equal lengths of the first filament 105*a* and the second filament 105*b*. Since the length difference between first filament 105*a* and second filament 105*b* limits the loops length at ATY 105, the ATY 105 will not be easily snagged due to their substantially equal lengths. In some embodiments, a difference between a length of the first filament 105*a* and a length of the second filament 105*b* is less than or substantially equal to 4%. In some embodiments, the length of the first filament 105*a* is substantially equal to the length of the second filament 105*b*. The first filament 105*a* and the second filament 105*b* have substantially the same length, but different cross-sectional profiles with different aerodynamic effects, and thus the ATY 105 formed by the first filament 105*a* and the second filament 105*b* have small, dense and uniform loops, which thus generates desired properties such as fluffy feeling and non-see-through effect.

In some embodiments, the first filament 105*a* and the second filament 105*b* are fed into the nozzle unit 103 by the feeding unit 102. In some embodiments, the nozzle unit 103 is configured to texturize the filaments 105*a* and 105*b* passing through the nozzle unit 103. In some embodiments, the first filament 105*a* and the second filament 105*b* are blown by a flow such as air, gas or liquid fluid supplied from the nozzle unit 103, such that the first filament 105*a* and the second filament 105*b* are mixed and texturized to become the ATY 105. In some embodiments, the air, gas or liquid fluid supplied from the nozzle unit 103 flows toward a predetermined direction.

In some embodiments, the ATY 105 is a combination of the first filament 105*a* and the second filament 105*b*. In some embodiments, the ATY 105 includes a plurality of the first filaments 105*a* and a plurality of the second filaments 105*b*.

As a result, loops protruding from the ATY 105 are formed. Since the first filament 105*a* and the second filament 105*b* are fed into the nozzle unit 103 at the same speed or approximately the same speed, the ATY 105 with small, dense and uniform loops can be produced.

In some embodiments, the ATY 105 is pulled out from the nozzle unit 103 by the delivery unit 104. In some embodiments, the delivery unit 104 is an output roller. In some embodiments, the ATY 105 is outputted from the nozzle unit 103 by the delivery unit 104 at an output speed. In some embodiments, the output speed is less than the first feeding speed or the second feeding speed. In some embodiments, a difference between the first feeding speed and the output speed ranges of about 6% to about 16%. In some embodiments, a difference between the first feeding speed and the output speed ranges of about 7% to about 14%. In some embodiments, a difference between the first feeding speed and the output speed ranges of about 8% to about 13%. In some embodiments, a difference between the second feeding speed and the output speed ranges of about 6% to about 16%. In some embodiments, a difference between the second feeding speed and the output speed ranges of about 7% to about 15%. In some embodiments, a difference between the second feeding speed and the output speed ranges of about 8% to about 14%. In some embodiments, an input speed of the feeding unit 102 is substantially same as the first feeding speed or the second feeding speed.

In some embodiments, the ATY 105 is wound by the take up unit 106. In some embodiments, the take up unit 106 is a take up roller for winding the ATY 105. The ATY 105 is finally wound around the take up unit 106.

Figure 2:
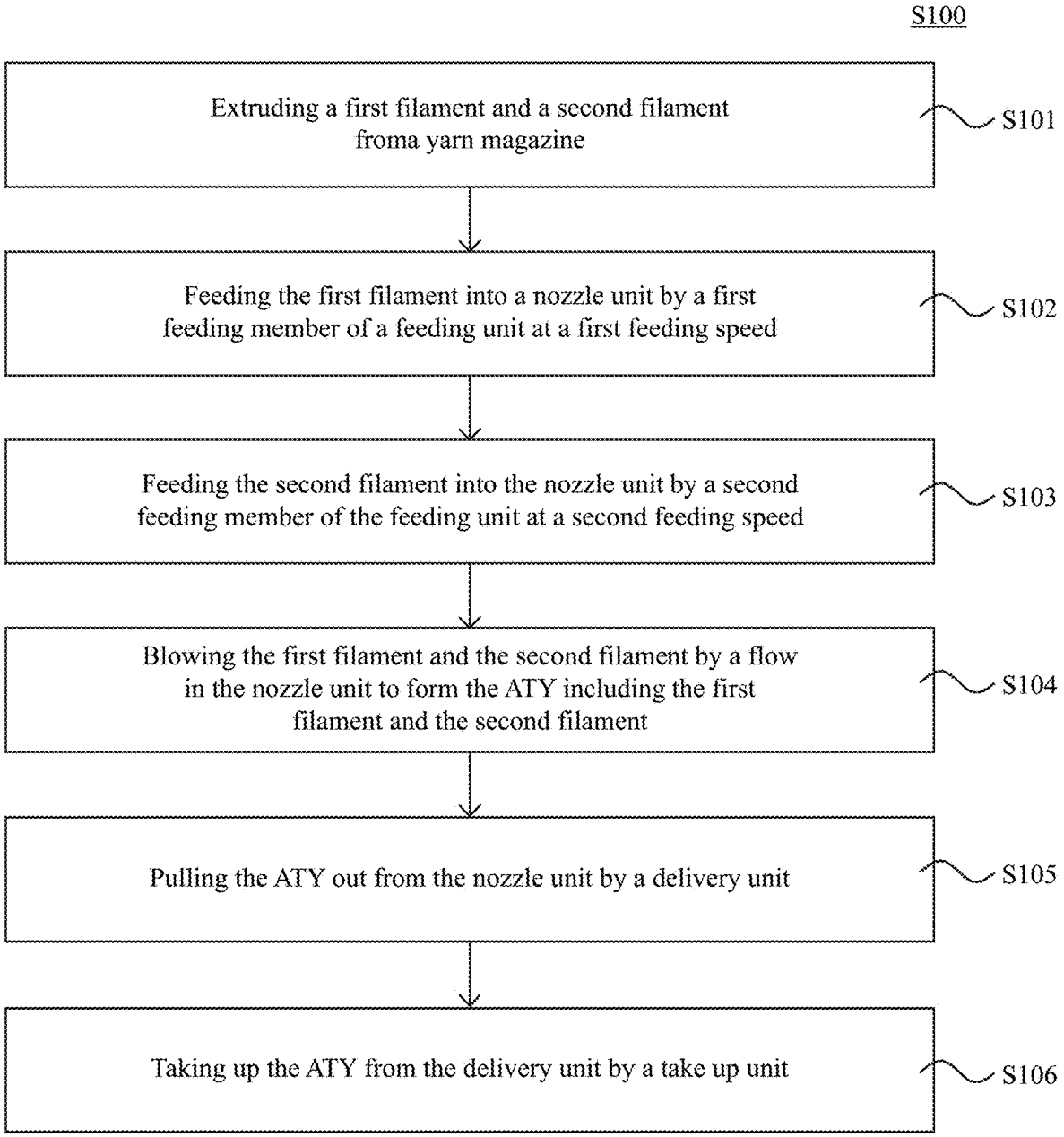
FIG. 2 is a flowchart illustrating a method of manufacturing an air textured yarn (ATY) according to various aspects of one or more embodiments of the present disclosure.

In the present disclosure, a method of manufacturing an ATY 105 is disclosed. In some embodiments, the ATY 105 is manufactured by implementing a method S100. FIG. 2 is an embodiment of the method S100 implemented by the air texturizing machine 100 as described above or illustrated in FIG. 1. The method S100 includes a number of operations and the description and illustration are not deemed as a limitation as the sequence of the operations. The method S100 may, but is not limited to, include a number of operations (S101, S102, S103, S104, S105 and S106). In some embodiments, the method S100 is implemented in automation.

In step S101, a first filament 105*a* and a second filament 105*b* are extruded from a yarn magazine 101. In some embodiments, the first filament 105*a* is extruded from the first extruding member 101*a*, and the second filament 105*b* is extruded from the second extruding member 101*b*. In some embodiments, after the first filament 105*a* and the second filament 105*b* are extruded from the yarn magazine 101, the first filament 105*a* and the second filament 105*b* are conveyed to the feeding unit 102. In some embodiments, the first filament 105*a* and the second filament 105*b* are conveyed to a first feeding member 102*a* and a second feeding member 102*b*, respectively.

In step S102, the first filament 105*a* is fed into a nozzle unit 103 by the first feeding member 102*a* of the feeding unit 102 at a first feeding speed. In a step S103, the second filament 105*b* is fed into the nozzle unit 103 by the second feeding member 102*b* of the feeding unit 102 at a second feeding speed. In some embodiments, the step S102 and the step S103 are implemented separately or simultaneously. In some embodiments, the first feeding speed and the second feeding speed are the same or approximately the same. In some embodiments, the difference between the first feeding speed and the second feeding speed is less than or substantially equal to 4%. Since the first filament 105*a* and the second filament 105*b* are fed into the nozzle unit 103 at a same or approximately same speed, the ATY 105 having loops with desired dimension, density and distribution can be produced.

In step S104, the first filament 105*a* and the second filament 105*b* are blown by a flow in the nozzle unit 103 to form the ATY 105. In some embodiments, the nozzle unit 103 supplies air, gas or liquid to blow the first filament 105*a* and the second filament 105*b* when the first filament 105*a* and the second filament 105*b* pass through the nozzle unit 103. In some embodiments, the blowing includes mixing and texturizing the first filament 105*a* and the second filament 105*b*.

Since the first filament 105*a* and the second filament 105*b* have different cross-sectional shapes, an aerodynamic effect on the first filament 105*a* is different from an aerodynamic effect on the second filament 105*b*. In some embodiments, the first filament 105*a* having a substantially circular cross section and an M ratio substantially equal to or less than 1.3 has a smaller effective contact surface than the second filament 105*b* having a polygonal cross section including 3 to 6 lobes, and therefore, the first filament 105*a* and the second filament 105*b* incur different degrees of turbulence. Further, loops protruding from the ATY 105 are formed. Since the first filament 105*a* and the second filament 105*b* are fed into the nozzle unit 103 at the same speed or approximately the same speed, the ATY 105 with small, dense and uniform crimps can be produced.

In step S105, the ATY 105 is pulled out from the nozzle unit 103 by a delivery unit 104. In some embodiments, the ATY 105 is a combination of the first filament 105*a* and the second filament 105*b*. In some embodiments, the ATY 105 is pulled out from the nozzle unit 103 at an output speed. In some embodiments, a difference between the output speed and the first feeding speed is substantially less than or equal to 16%. In some embodiments, a difference between the output speed and the second feeding speed is substantially less than or equal to 16%.

In step S106, the ATY 105 is taken up from the delivery unit 104 by a take up unit 106. In some embodiments, the ATY 105 is finally wound around the take up unit 106.

Although FIGS. 1 and 2 describe that the first filament 105*a* and the second filament 105*b* are combined prior to being fed into the nozzle unit 103, it can be understood that the first filament 105*a* and the second filament 105*b* can be combined before entering the air texturing machine 100, or even several (e.g., more than three) filaments can be combined before entering the air texturing machine 100. For example, the first filament 105*a* and the second filament 105*b* can be combined by a melt spinning process prior to the air texturing process implemented by the air texturing machine 100.

Figure 3:
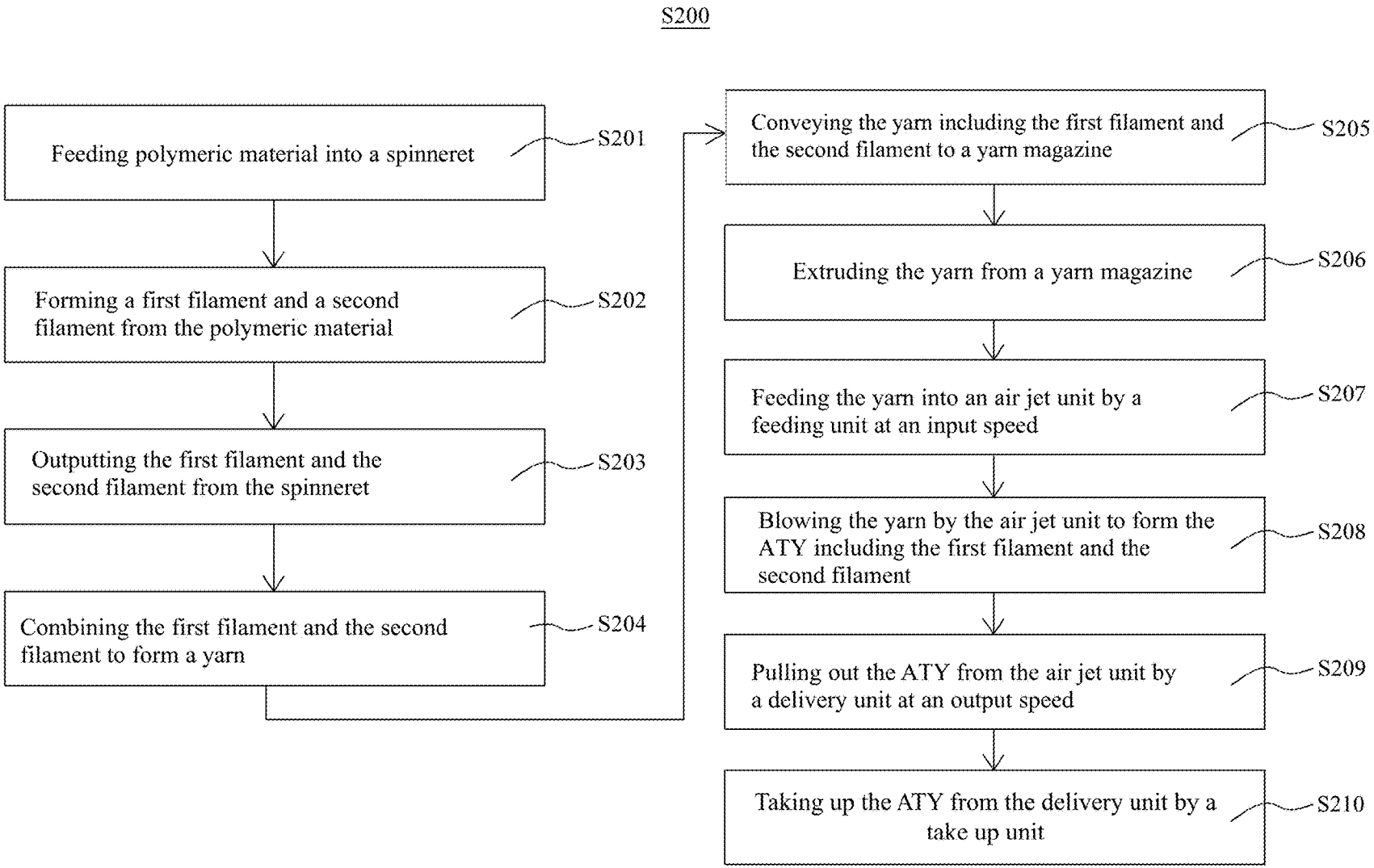
FIG. 3 is a flowchart illustrating another method of manufacturing an air textured yarn (ATY) according to various aspects of one or more embodiments of the present disclosure.

In the present disclosure, another method of manufacturing the ATY 105 is disclosed. In some embodiments, the ATY 105 is manufactured by implementing another method S200. FIG. 3 is an embodiment of the method S200 of performing the melt spinning process by a melt spinning machine and the air texturing process by the air texturizing machine 100 as described above or illustrated in FIG. 1. The method S200 includes a number of operations and the description and illustration are not deemed as a limitation to the sequence of the operations. The method S200 may, but is not limited to, include a number of operations (S201, S202, S203, S204, S205, S206, S207, S208, S209 and S210). In some embodiments, the method S200 is implemented in automation.

In step S201, polymeric material is fed into a spinneret. In some embodiments, the polymeric material is polymer melt, polymer solution or the like. In some embodiments, the polymeric material includes polyester, nylon, polypropylene or the like. In some embodiments, the spinneret is configured to extrude the polymeric material to become fiber or filament. In some embodiments, the spinneret is in a configuration as generally known in the art. In some embodiments, the polymeric material is fed into several spinnerets separated from each other.

In step S202, a first filament 105*a* and a second filament 105*b* are formed from the polymeric material. In some embodiments, the first filament 105*a* and the second filament 105*b* are formed by one or more spinnerets. In some embodiments, the first filament 105*a* having a first cross section and the second filament 105*b* having a second cross section substantially different from the first cross section are formed by one or more spinnerets. In some embodiments, the first cross section of the first filament 105*a* has a circular shape, and the second cross section of the second filament 105*b* is a pentagram or hexagram. In some embodiments, the second cross section of the second filament 105*b* has an M ratio substantially greater than 1.5.

In step S203, the first filament 105*a* and the second filament 105*b* are outputted from one or more spinnerets. In some embodiments, the first filament 105*a* and the second filament 105*b* are outputted from the spinnerets respectively. In some embodiments, the first filament 105*a* and the second filament 105*b* are outputted from the same spinneret. In some embodiments, the first filament 105*a* and the second filament 105*b* are outputted from separate respective spinnerets.

In step S204, the first filament 105*a* and the second filament 105*b* are combined to form a yarn. In some embodiments, the first filament 105*a* and the second filament 105*b* are combined together to become the yarn including the first filament 105*a* and the second filament 105*b*. In some embodiments, the yarn including the first filament 105*a* and the second filament 105*b* is drawn and heat-set based on the melt spinning process generally known in the art, and the yarn is then wound up on a cone. Subsequently, the cone is conveyed to a yarn magazine 101 of the air texturing machine 100 for the air texturing process as described above or illustrated in FIG. 1.

In step S205, the yarn including the first filament 105*a* and the second filament 105*b* is conveyed to the yarn magazine 101. In step 206, the yarn including the first filament 105*a* and the second filament 105*b* is extruded from the yarn magazine 101. In some embodiments, after the yarn is extruded from the yarn magazine 101, the yarn is conveyed to a feeding unit 102.

In step S207, the yarn is fed into a nozzle unit 103 by the feeding unit 102 at an input speed. In step S208, the yarn is blown by the nozzle unit to form the ATY 105 including the first filament 105*a* and the second filament 105*b*. In some embodiments, the step S208 is similar to the step S104 described above.

In step S209, the ATY 105 is pulled out from the nozzle unit 103 by a delivery unit 104 at an output speed. In some embodiments, a difference between the input speed and the output speed ranges of about 6% to 16%. In some embodiments, the step S209 is similar to the step S105 described above. In step S210, the ATY 105 is then taken up from the delivery unit 104 by a take up unit 106, similar to the step S106 described above.

Figure 4:
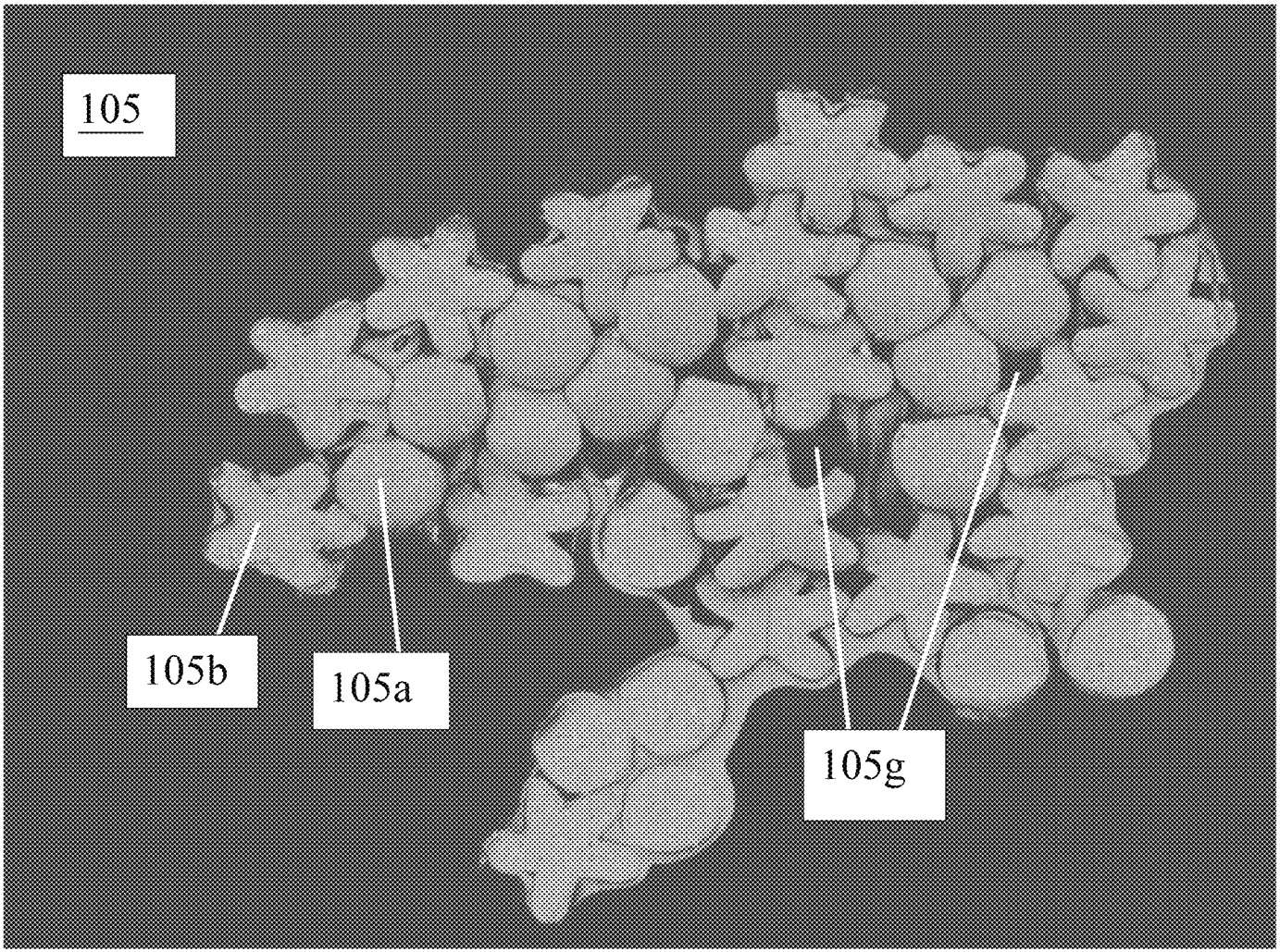
FIG. 4 is a microscopic image showing a cross-sectional view of an air textured yarn (ATY) according to one embodiment of the present disclosure.

In the present disclosure, an air textured yarn (ATY) is disclosed. In some embodiments, the ATY 105 is manufactured by the air texturing machine 100 as described above or illustrated in FIG. 1. In some embodiments, the ATY 105 is manufactured by the method S100 as described above or illustrated in FIG. 2 or the method S200 as described above or illustrated in FIG. 3. FIG. 4 is a microscopic image showing a cross-sectional view of the ATY 105 according to one embodiment of the present disclosure.

In some embodiments, the ATY 105 includes at least two filaments with different cross-sectional shapes. In some embodiments, the ATY 105 includes the first filament 105*a* and the second filament 105*b*. In some embodiments, the first filament 105*a* and the second filament 105*b* are uniformly distributed in the ATY 105. In other words, the first filament 105*a* and the second filament 105*b* are uniformly mixed with each other.

In some embodiments, the first filament 105*a* has a first cross section, and the second filament 105*b* has a second cross section. In some embodiments, the first cross section of the first filament 105*a* is different from the second cross section of the second filament 105*b*. In some embodiments, the first cross section has a substantially circular shape and has an M ratio substantially equal to or less than 1.3. In some embodiments, the second cross section has a polygonal shape including 3 to 6 lobes. In some embodiments, the second cross section has the polygonal shape including 5 or 6 lobes. In some embodiments, the second cross section is a tri-lobe shape, a four-lobe shape, a star, a pentagram, a hexagram, a heptagram, an octagram or the like.

In some embodiments as shown in FIG. 4, the first cross section of the first filament 105*a* has a substantially circular shape, and the second cross section of the second filament 105*b* is a polygonal shape including 5 lobes. In some embodiments, the first cross section of the first filament 105*a* is free of a lobe and a recess. In some embodiments, the second cross section includes several lobes protruding from a central portion of the second filament 105*b*, and several recesses between the lobes. In some embodiments, each of the recesses is disposed between two adjacent lobes. In some embodiments, the ATY 105 includes a void 105*g* surrounded by the first filament 105*a* and the second filament 105*b*.

In some embodiments as shown in FIG. 4, at least a portion of the first filament 105*a* is disposed between two adjacent lobes of the second filament 105*b*. In some embodiments, two adjacent second filaments 105*b* are interlocked with each other. In some embodiments, one of the lobes of the second filament 105*b* is disposed between two adjacent lobes of another second filament 105*b*.

Figure 5:
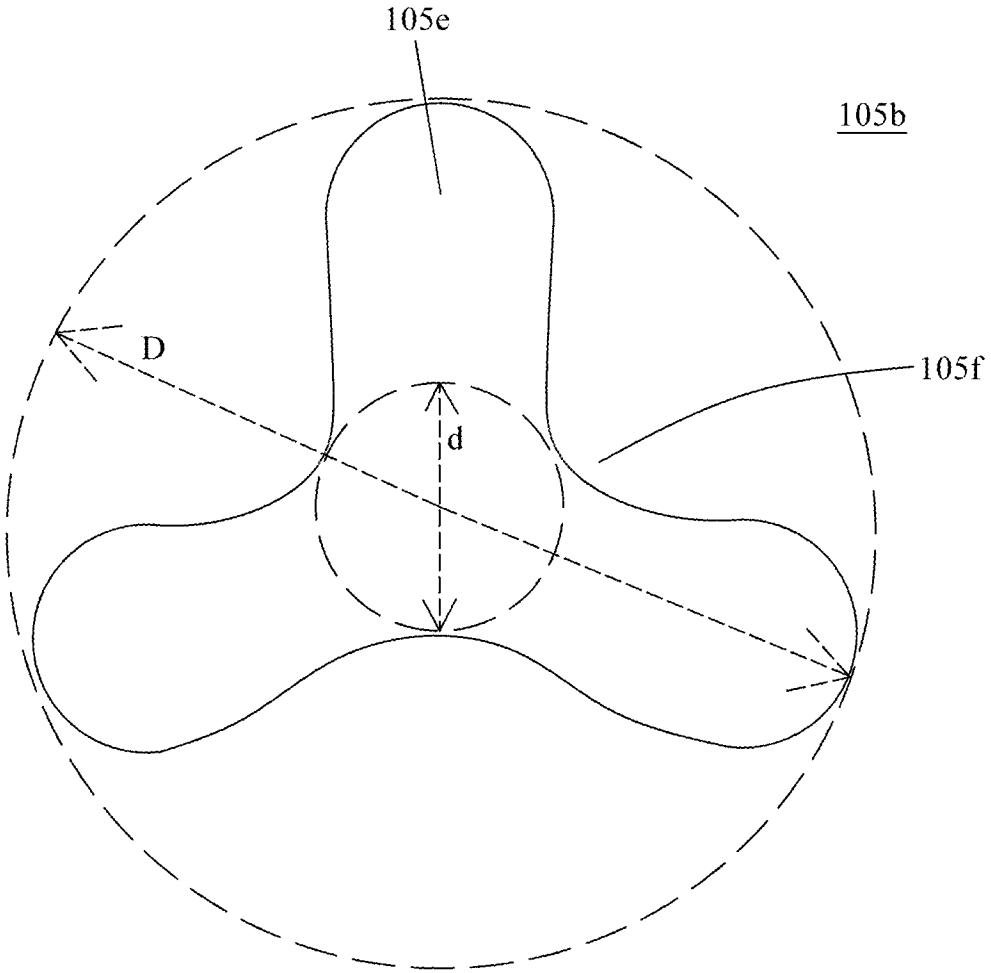
FIG. 5 is a schematic cross-sectional view of a filament having a tri-lobe shape according to one embodiment of the present disclosure.
Figure 6:
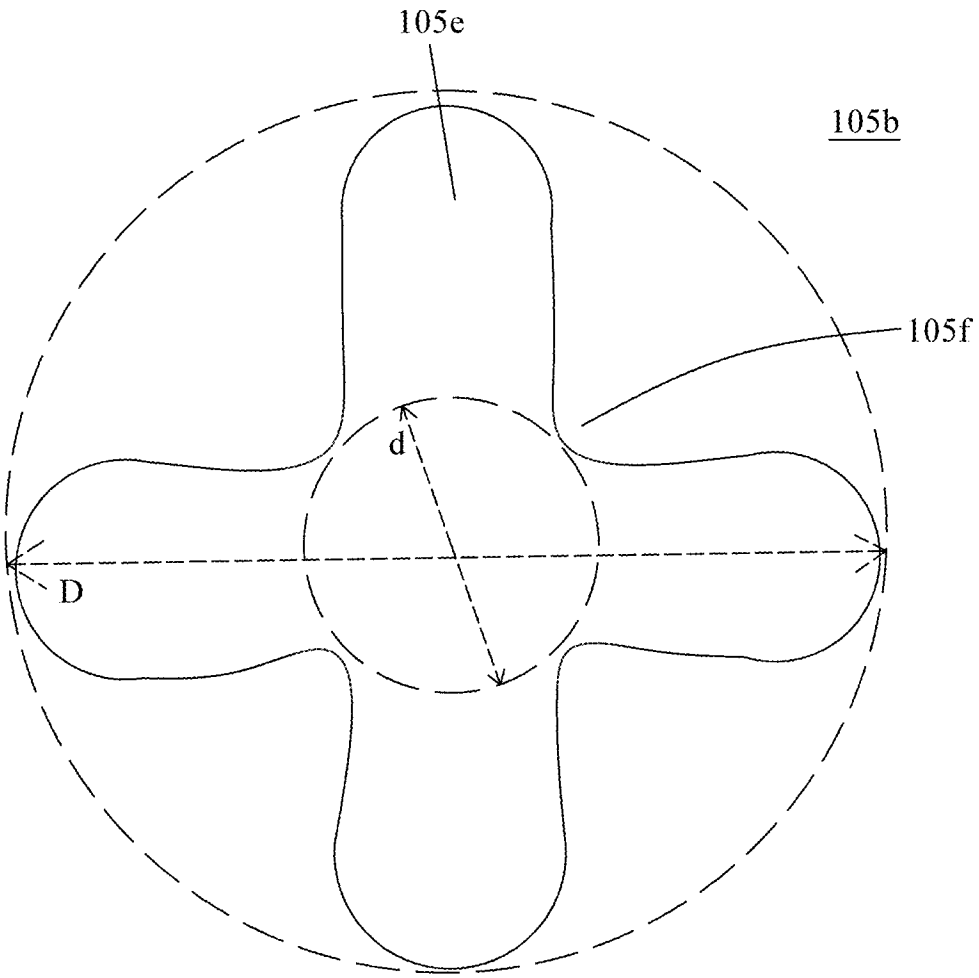
FIG. 6 is a schematic cross-sectional view of a filament having a crisscross shape according to one embodiment of the present disclosure.
Figure 7:
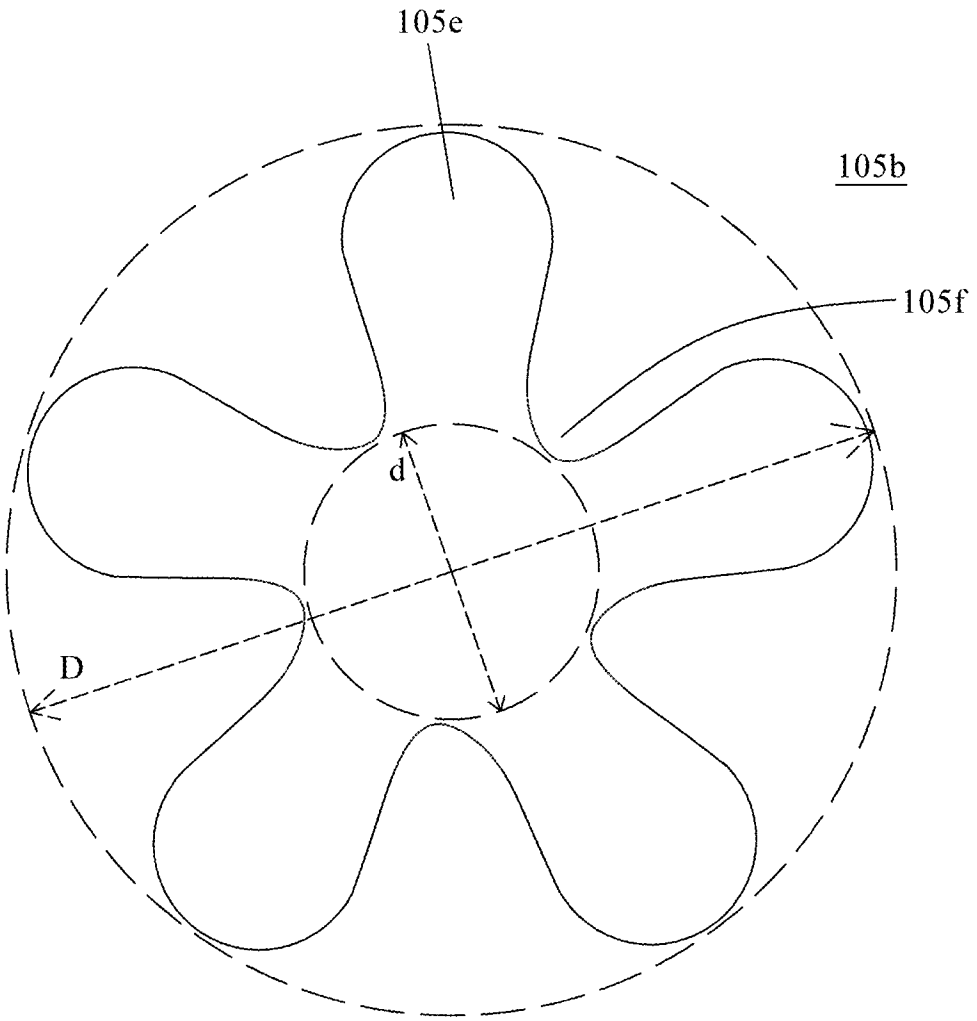
FIG. 7 is a schematic cross-sectional view of a filament having a pentagram shape according to one embodiment of the present disclosure.
Figure 8:
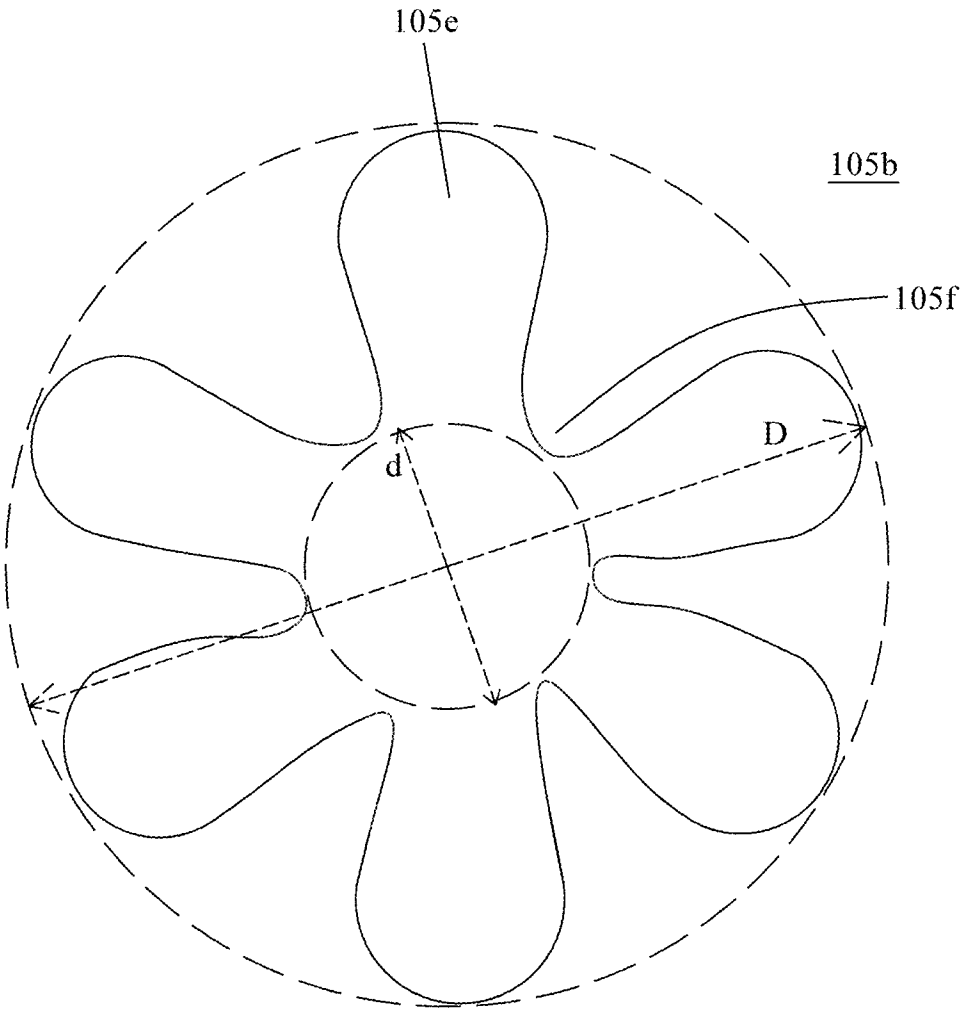
FIG. 8 is a schematic cross-sectional view of a filament having a hexagram shape according to one embodiment of the present disclosure.

FIGS. 5 to 8 illustrate various schematic cross-sectional views of the second filament 105*b* according to embodiments of the present disclosure. In some embodiments as shown in FIG. 5, the second cross section has the polygonal shape including 3 lobes. In some embodiments as shown in FIG. 6, the second cross section has the polygonal shape including 4 lobes. In some embodiments as shown in FIG. 7, the second cross section has the polygonal shape including 5 lobes. In some embodiments as shown in FIG. 8, the second cross section has the polygonal shape including 6 lobes.

In some embodiments, as shown in FIGS. 5 to 8, the second cross section includes several lobes 105*e* protruding from the central portion of the second filament 105*b*, and several recesses 105*f* between the lobes 105*e*. In some embodiments, each of the recesses 105*f* is disposed between two adjacent lobes 105*e*.

In some embodiments, the second cross section of the second filament 105*b* has a major axis with a first length D and a minor axis with a second length d. In some embodiments, the first length D is a longest diameter of the second cross section, and the second length d is a shortest diameter of the second cross section. In some embodiments, the central portion of the second filament 105*b* has the second length d. In some embodiments, the second cross section of the second filament 105*b* can be measured at predetermined magnifications when using a microscope, and a ratio of the first length D to the second length d can then be calculated. In some embodiments, the ratio D:d is defined as a degree of modification, which is also referred to as an M ratio. In some embodiments, the second filament 105*b* has an M ratio (D:d) substantially greater than 1.5. In some embodiments, the M ratio of the second filament 105*b* is substantially greater than 2. In some embodiments, the M ratio of the second filament 105*b* is in a range of about 1.6 to about 3. In some embodiments, as shown in FIGS. 5 to 8, the second filament 105*b* has the M ratio (D:d) substantially greater than 1.5.

Figure 9:
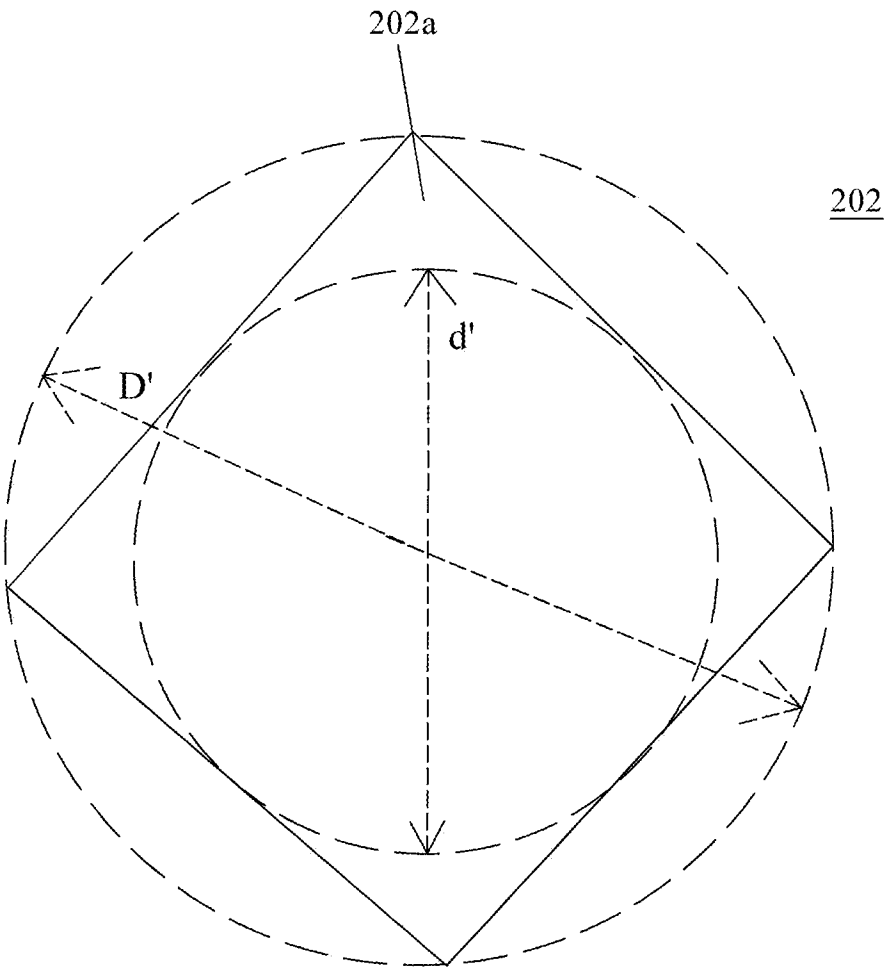
FIGS. 9 to 11 are schematic cross-sectional views of filaments having a degree of modification (M ratio) less than or substantially equal to 1.3.
Figure 10:
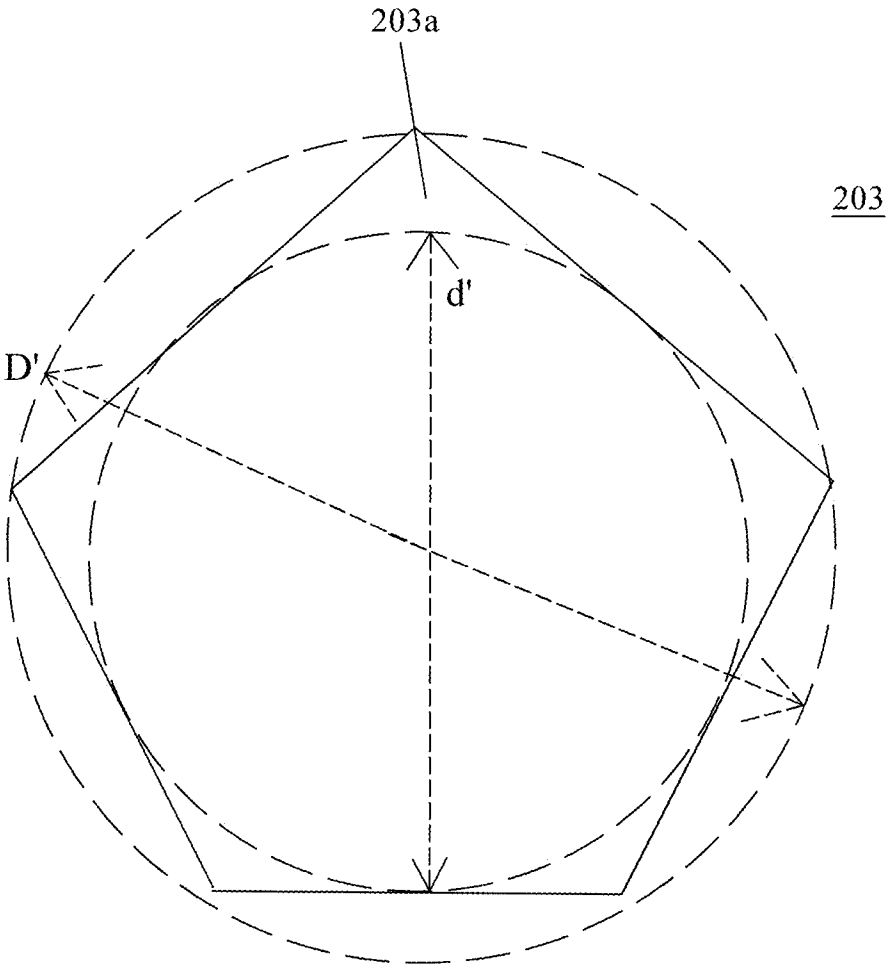
Figure 11:
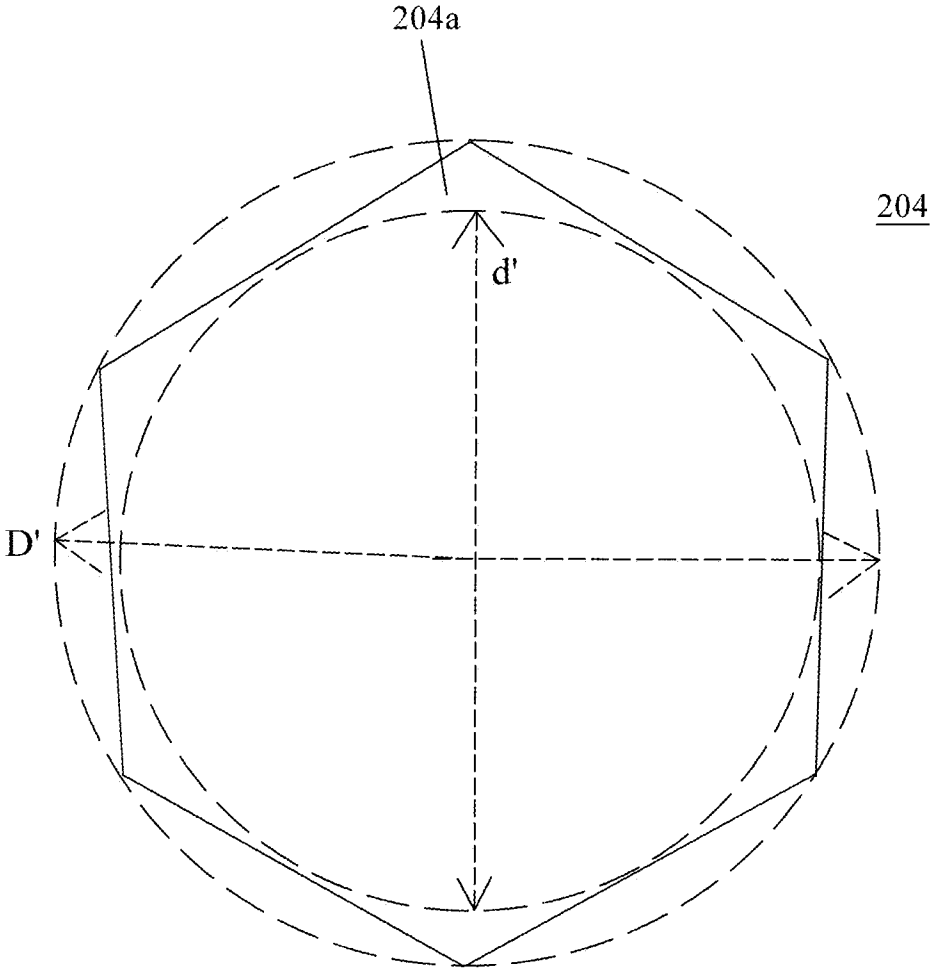

FIGS. 9 to 11 illustrate various schematic cross-sectional views of the first filament 105*a* according to embodiments of the present disclosure. In some embodiments, the first cross section has a substantially circular shape and has the M ratios (D':d') less than or substantially equal to 1.5. The M ratios of the first cross sections of the first filament 105*a* as shown in FIGS. 9 to 11, are 1.3, 1.2 and 1.1, respectively. In some embodiments, the first cross section of the first filament 105*a* is a circular shape. In some embodiments, the M ratio of the first cross section of the first filament 105*a* is substantially equal to 1.

Referring back to FIG. 4, the ATY 105 includes the first filament 105*a* and the second filament 105*b* having cross-sectional profiles different from each other. Because the different cross-sectional profiles create different aerodynamic effects during the air texturizing process, the ATY 105 having loops with desired dimension, density and distribution can be produced.

In some embodiments, the ATY 105 includes the first filament 105*a*, the second filament 105*b* and a third filament (not shown) having cross-sectional profiles different from each other. In some embodiments, the third filament disposed adjacent to the first filament 105*a* and the second filament 105*b*, and has a third cross section. In some embodiments, the third cross section is different from the second cross section and has a polygonal shape including 3 to 6 lobes. In some embodiments, the configuration of the third cross section of the third filament is shown in FIGS. 5 to 8. In some embodiments, the void 105*g* is surrounded by at least one of the first filament 105*a*, the second filament 105*b* and the third filament. In some embodiments, the void 105*g* is adjacent to the third filament. In some embodiments, the loop is formed by the third filament.

Figure 12:
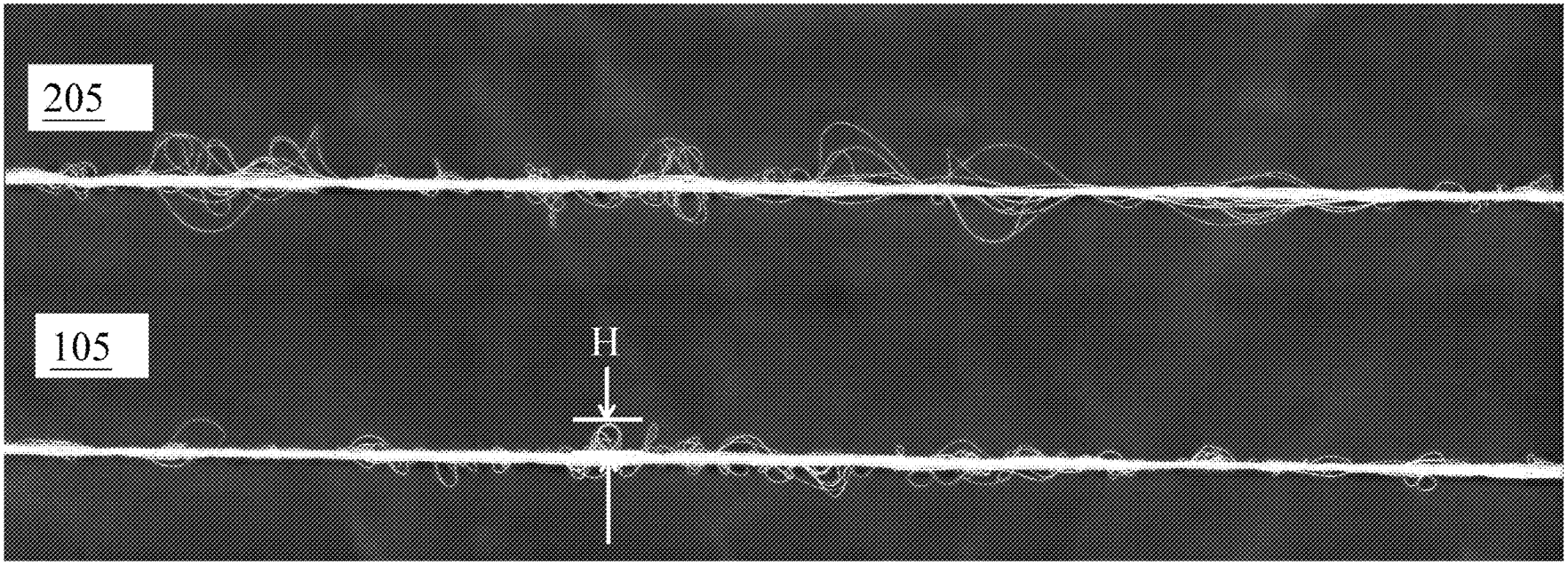
FIG. 12 shows schematic side views of an air textured yarn (ATY) according to one embodiment of the present disclosure and a comparative example yarn.

FIG. 12 illustrates microscopic images of a side view of the ATY 105 produced by the air texturing machine 100 described above or illustrated in FIG. 1, the manufacturing method S100 described above or illustrated in FIG. 2, or the manufacturing method S200 described above or illustrated in FIG. 3. In some embodiments, as shown in FIG. 12, the ATY 105 has small, dense and uniform loops, and therefore the ATY 105 loops can offer a desirable fluffy, comfortable or cotton-like feeling and will not be easily snagged.

In some embodiments, the loop protruding from the ATY 105 has a height H of less than 480 μm. In some embodiments, the height H of the loop is in a range of about 150 μm to about 480 μm. In some embodiments, the height H of the loop is in a range of about 100 μm to about 280 μm.

In contrast, loops of comparative example yarn 205 produced by other texturing machine or other texturing method are larger, less dense and less uniform compared to the loops of the ATY 105. The comparative example yarn 205 has larger and longer loops and thus can be easily snagged.

Figure 13:
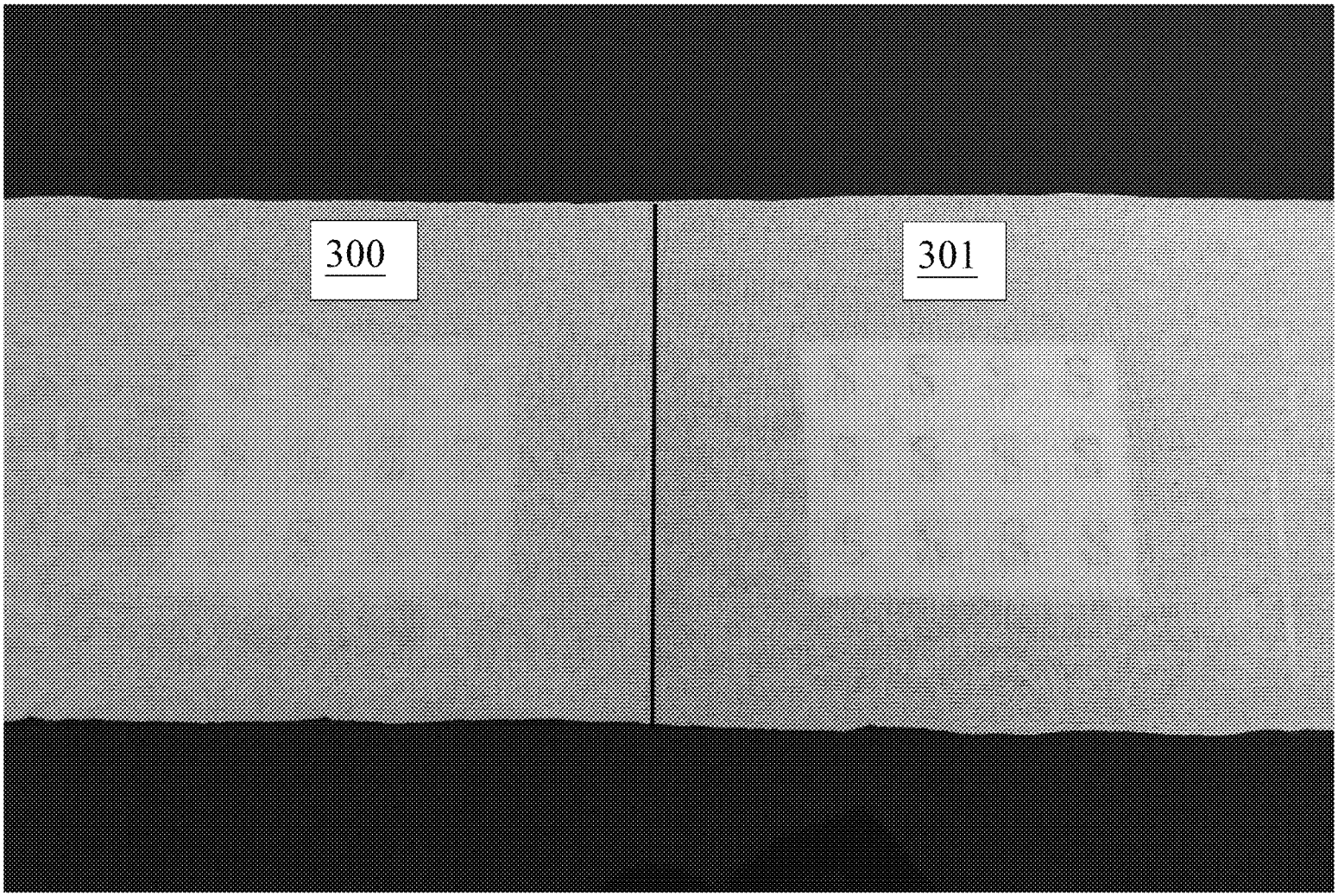
FIG. 13 shows schematic top views of a fabric made of the air textured yarn (ATY) according to one embodiment of the present disclosure and a comparative example fabric.

In the present disclosure, a fabric, garment or clothing made of the ATY 105 is disclosed. FIG. 13 illustrates a fabric 300 made of the ATY 105 as described above or illustrated in FIG. 4 according to one embodiment of the present disclosure, as well as a comparative example fabric 301 made of other yarns. In some embodiments, the fabric 300 has a low see-through effect. As shown in FIG. 13, the fabric 300 has a lower see-through effect than the comparative example fabric 301. In other words, an object behind the fabric 300 cannot be clearly seen, while the object behind the comparative example fabric 301 can be clearly seen.

In conclusion, the ATY of the present disclosure includes a first filament and a second filament having a length difference substantially equal to or less than 4%. Further, the first filament and the second filament are fed into a nozzle unit at a same or approximately same feeding speed, and then texturized by the nozzle unit, such that the first filament and the second filament can have substantially equal lengths. The substantially equal lengths of the first filament and the second filament can prevent the ATY from being easily snagged. The first filament and the second filament have different M ratios. For example, the first filament has a substantially circular cross section and has an M ratio substantially equal to or less than 1.3, and the second filament has a polygonal cross section. The M ratio of the second filament may be greater than 1.5. The cross section of the second filament is different from the first cross section and has a polygonal shape including 3 to 6 lobes. The first filament and the second filament have different cross-sectional profiles with different aerodynamic effects, and thus the ATY formed by the first filament and the second filament have small, dense and uniform loops to achieve desired properties such as fluffy feeling and non-see-through effect.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods or steps, presently existing or later to be developed, that perform substantially the same function or achieve substantially the same result as the corresponding embodiments described herein, may be utilized according to the present disclosure. Accordingly, the appended claims are intended to include within their scope such processes, machines, manufacture, compositions of matter, means, methods and steps.

What is claimed is:

1. An air textured yarn (ATY), comprising:

a first filament having a first cross section;

a second filament disposed adjacent to the first filament and having a second cross section; and a loop formed by the first filament or the second filament, wherein a height of the loop is less than 480 μm, the first cross section has a substantially circular shape and has a degree of modification (M ratio) less than or substantially equal to 1.3, the second cross section different from the first cross section has a polygonal shape including 3 to 6 lobes, and a difference between a length of the first filament and a length of the second filament is s equal to 0%.

2. The ATY of claim 1, wherein the second cross section has an M ratio greater than 1.5.

3. The ATY of claim 2, wherein the M ratio of the second cross section is in a range of about 1.6 to about 3.

4. The ATY of claim 1, wherein the second cross section has the polygonal shape including 5 or 6 lobes.

5. The ATY of claim 1, further comprising:

a third filament disposed adjacent to the first filament and the second filament and having a third cross section, wherein the third cross section is different from the first cross section of the first filament and the second cross section of the second filament.

6. A fabric comprising the ATY as claimed in claim 1.

* * * * *